United States Patent [19]

DeNiro

[11] Patent Number: 4,892,304

[45] Date of Patent: Jan. 9, 1990

[54] LEG STRENGTHENING AND STRETCHING APPARATUS

[76] Inventor: Vincent L. DeNiro, 490 W. Midmorning Blvd., Youngstown, Ohio 44511

[21] Appl. No.: 234,403

[22] Filed: Aug. 19, 1988

Related U.S. Application Data

[63] Continuation-in-part of Ser. No. 37,693, Apr. 13, 1987, abandoned.

[51] Int. Cl.[4] ..... A63B 23/00

[52] U.S. Cl. ..... 272/126; 272/118; 272/134; 272/903

[58] Field of Search ..... 272/76, 93, 117, 118, 272/126, 134, 144, 145, 903; 128/25 R, 73, 79, 80 R, 83.5, 84 C

[56] References Cited

U.S. PATENT DOCUMENTS

| | | | |
|---|---|---|---|
| 2,210,269 | 8/1940 | Taylor | 128/25 R |
| 4,125,258 | 11/1978 | McArthur | 272/118 |
| 4,139,193 | 2/1979 | Felber et al. | 272/146 |
| 4,531,730 | 7/1985 | Chenera | 272/144 |
| 4,647,040 | 3/1987 | Ehrenfried | 272/126 |

FOREIGN PATENT DOCUMENTS

| | | | |
|---|---|---|---|
| 2537007 | 6/1984 | France | 272/93 |
| 1238771 | 6/1986 | U.S.S.R. | 272/93 |

OTHER PUBLICATIONS

"Power Kicker", Blackbelt, Apr. 1984, p. 98.

*Primary Examiner*—Richard J. Apley
*Assistant Examiner*—J. Welsh
*Attorney, Agent, or Firm*—Clifford A. Poff

[57] ABSTRACT

An isotonic exercise apparatus for stretching and strengthening leg muscles of a user comprises a body support and an exercise leg support extending outwardly therefrom. The exercise leg support is hinged to allow a user to flex an exercise leg at the knee. Conventional mechanical deadweights attached to the exercise leg support resist rotation of the exercise leg support during flexing of the exercise leg, thereby strengthening the leg of the user.

23 Claims, 5 Drawing Sheets

LEG STRENGTHENING AND STRETCHING APPARATUS

CROSS REFERENCE TO RELATED APPLICANT'S

This is a continuation-in-part of application Ser. No. 037,693, Filed Apr. 13, 1987, now abandoned.

BACKGROUND OF THE INVENTION

1. Field of the Invention

The present invention relates generally to exercise apparatus, and, more particularly, to a leg-stretching and strengthening apparatus to aid in the development of muscles utilized during kicking motions.

2. Desription of the Prior Art

There are a number of athletic activities which require an athlete to perform kicking motions. A particular example of a sport requiring such a motion is Karate which not only requires the athlete to perform a kicking motion, but also requires the kicking motion to be performed while a leg of the athlete is positioned at an upwardly extending angle. Such a motion entails stretching of leg muscles.

In the past, various machines and exercise devices have been developed for performing leg stretching exercises. For example, an exercise device is disclosed in U.S. Pat. No. 4,277,062 to facilitate the stretching of leg muscles to allow a user to stretch into a "split" position. The device requires a user to set on a platform from which a rightwardly extending bar and a leftwardly extending bar extend. A pulley is mounted at the end of each of the bars to allow a first cable and a second cable to pass therethrough. The user inserts his feet into stirrups attached to first ends of the cables, and grips the second ends of the cables with his hands. By pulling on the cables, the legs of the user are stretched apart, until the user is in the split position. Similarly, a leg stretching machine disclosed in U.S. Pat. No. 4,445,684 facilitates the stretching of leg muscles to also allow a user to also stretch into a "split" position. Once again, a user is required to sit on a platform, with the platform having a rod extending outwardly therefrom. Backwardly extending rods attached thereto contact with the insides of the legs of a user. By causing the backwardly extending rods to move towards the user, the legs of the user are forced apart and into a split position. Still another patent, U.S. Pat. No. 4,456,247, discloses a leg stretching apparatus. Once again, the apparatus requires a user to sit on a platform having leg supports extending outwardly therefrom. The user places his legs upon the leg supports, and the leg supports are forced apart by a cranking mechanism, thereby spreading the legs of the user into a split position.

In all of the exercise devices disclosed in the prior art, however, the user is required to sit in a horizontal position, and the legs of the user are split apart horizontally. Further, all of the exercise devices function merely to increase the flexibility of the legs of a user. None of the devices function to develop the muscles of the legs of the user, nor do any of the devices recreate the actual movements of an overhead kicking motion.

It is therefore an object of the present invention to provide an apparatus which aids in the muscular development of those muscles utilized during athletic activities requiring kicking motions to be performed.

It is a further object of the present invention to provide an apparatus which increases the flexibility of the muscles of a user, while at the same time, also aiding in the muscular development of those muscles.

It is a yet further object of the present invention to provide an apparatus to aid in the development of those muscles required for an overhead kicking motion, such as an overhead kick used in the sport of Karate.

SUMMARY OF THE INVENTION

According to the present invention, a strengthening and stretching apparatus is disclosed for aiding in the development of leg muscles of a user used during a kicking motion. The apparatus includes a body support for supporting a user in an upstanding position, a first exercise leg support extending from the body support at an angle for supporting one leg of the user and a second exercise leg support rotatably attached to the first exercise leg support. In the preferred embodiment, a resistance means is attached to the second exercise leg support to resist rotation of the second exercise leg support. The body support may include a support leg retainer for retaining one leg of the user in an upright support position, and a torso support for supporting the torso of the user during use of the apparatus.

Preferably, the support leg retainer is of an adjustable height to allow users of different heights to position their legs thereagainst. The exercise leg support means may further include an adjustment means to adjust the angle at which the first exercise leg support extends from the body support means. The exercise leg support means is also preferably of an adjustable length to accommodate users of various heights. In the preferred embodiment, the resistance means to resist the movement of the lower leg support means is comprised of mechanical deadweights engaged with the second exercise support means by a cable and pulley assembly.

BRIEF DESCRIPTION OF THE DRAWINGS

The features and advantages of the present invention will be more fully understood when the description is read in light of the accompanying drawings in which.

DETAILED DESCRIPTION OF THE PREFERRED EMBODIMENT

Figure 1:
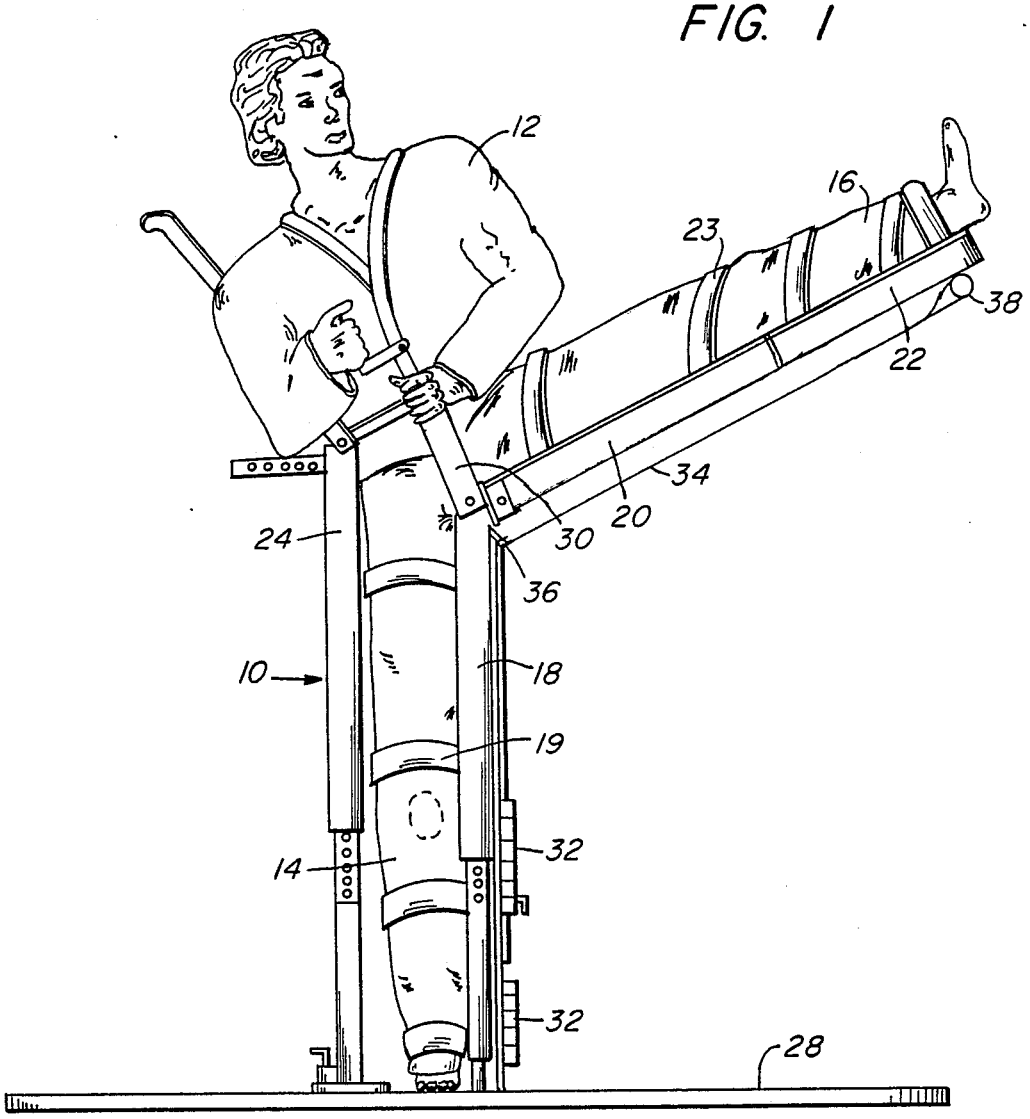
FIG. 1 is a schematic illustration of the leg strengthening and stretching apparatus of the present invention with a user positioned thereupon.

Referring to Figurue 1, there is shown generally the leg strengthening and stretching apparatus 10 of the present invention with a user 12 positioned thereupon to perform exercises with the apparatus 10. The user 12 stands in an upright position with on eleg, the support leg 14, in a support position, and a second leg, the exercise leg 16, in an exercise position. To prevent user 12 from becoming unbalanced, support leg 14 is positioned against support leg retainer 18 and supported thereagainst by a series of suppport straps 19. Exercise leg 16 is supported upon upper leg support 20 and lower leg support 22 and supported thereupon by a series of support straps 23 similar to straps 19. Straps 19 and 23 may, for example, be comprised of a cloth material having velcro (tm) ends.

In the preferred embodiment of FIG. 1, further support is given to the upper body of the user 12 by torso retainer 24. Both torso retainer 24 and suppot leg retainer 18 are mounted upon base plate 28. Further illustrated in FIG. 1 is hand grip assembly 30 which functions to position support 20 at a desired angle and to aid the user 12 in maintaining his balance when performing exercises on the apparatus 10. While not illustrated, a second hand grip assembly 30 is positioned behind the user 12 for performing the same function when user 12 faces the opposite direction. Also illustrated are a series of mechanical deadweights 32 which connected with lower leg support 22 through cable 34, pulley 36, and attaching means 38.

Figure 2A:
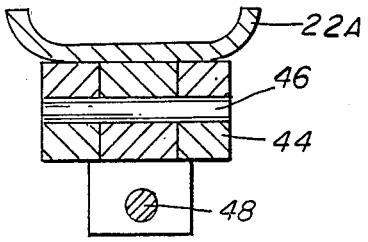
FIG. 2A is a cross sectional view taken along lines II—II of FIG. 2.
Figure 2:
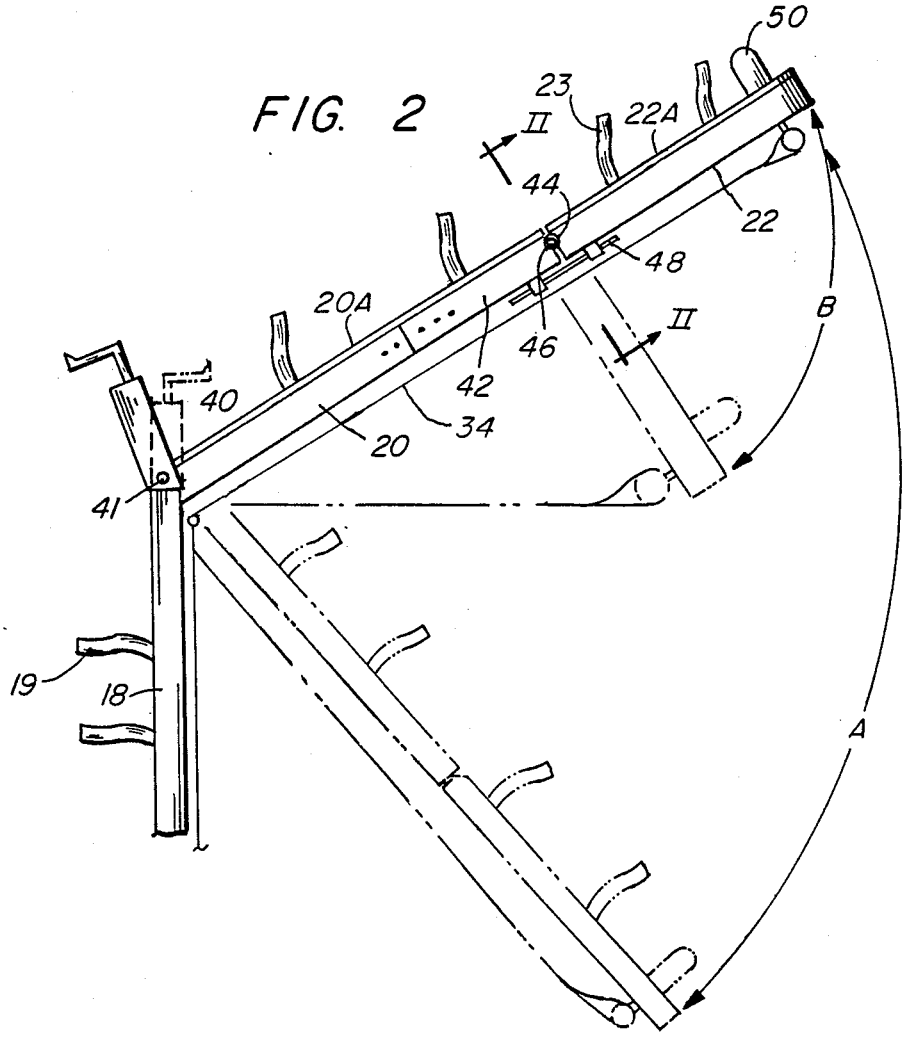
FIG. 2 is a side view illustration of the exercise leg supports of the present invention which allow the user to recreate a kicking motion.

Referring now to the illustration of FIG. 2, there is shown a side view schematic of exercise leg supports 20 and 22. Also illustrated in phantom line are various positions of the supports 20 and 22. Upper leg support 20 contains vertical hinge 40 at an end proximate to support leg retainer 18. Rod 41 extends through hinge 40 and is fixedly connected thereto. Rotation of rod 41 therefore causes hinge 40 and support 20 to rotate about rod 41. Rotation of supports 20 and 22 is permitted through various angles including that illustrated in phantom line marked "A" in FIG. 2. Exercise leg support 20 contains an adjustable extension 42 to allow the length of leg support 20 to be adjusted to correspond to the size of user 12.

At the end of the support 20 positioned away from leg retainer 18 is vertical hinge 44 which connects with a mated hinge on lower leg support 22 by hinge pin 46 to allow support 22 to be pivoted about pin 46. Rotation of support 22 is permitted through various angles including that illustrated in phantom line marked "B" in FIG. 2. Locking bar 48 may be removably positioned to attach lower leg support 22 to upper leg support 20 to prevent rotation of support 22 about hinge 46. When positioned to prevent such rotation, both supports 20 and 22 pivot about vertical hinge 41 as described hereinabove.

Supports 20 and 22 each contain U-shaped platforms 20A and 22A, respectively. Platforms 20A and 22A preferably have mounted thereon elastic vinyl padding. In the preferred embodiment, moreover, lower leg support 22 further contains removable foot pad 50 to allow a user 12 to position the foot of exercise leg 16 therethrough. Foot pad 50 may be attached to support 22 by any conventional means.

Figure 3:
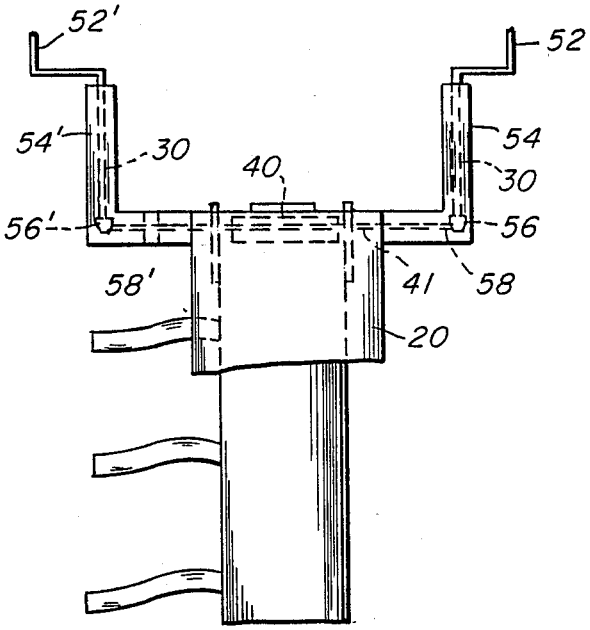
FIG. 3 is an exploded view of the hand grip and crank means of the present invention.

FIG. 3 illustrates a partial side view of the hand grips 30 of the present invention. Hand grips 30 function to allow a user 12 to maintain his balance during use of the apparatus 10, and further, functions to determine the angle at which support 20 extends from the support leg retainer 18.

Crank grips 52 and 52' which contain rotatable shafts 54 and 54' extending through hand grips 30 contain bevel gears 56 and 56' at the bottom ends thereof. Matching level gears 58 and 58', respectively, are connected to opposite ends of rod 41. Locking mechanism 59, positioned along the length of rod 41 prevents rotation of the rod once rod 41 is rotated to a desired angle. Hinge 40, as described hereinabove is fixedly attached to rod 41.

Figure 3A:
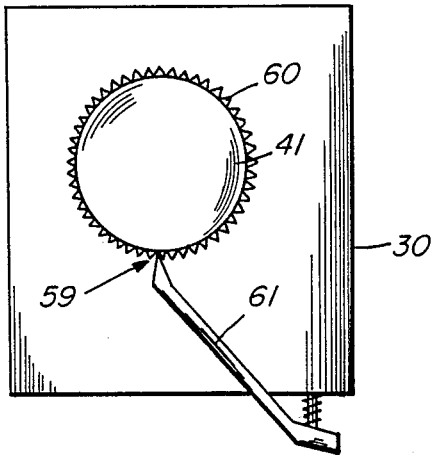
FIG. 3A is an exploded side view of a portion of FIG. 3 illustrating the locking mechanism utilized by the present invention to lock the exercise leg supports at a desired angle relative to the body support.

Illustrated in FIG. 3A is an exploded side view of the locking mechanism 59 utilized by the present invention. A spur gear 60 is attached about the periphery of rod 41 at some point along the length thereof. One end of spring loaded latching bar 61 contacts with the gear teeth of gear 60 to allow rotation of the rod 41, but preventing rotation of rod 41 in an opposite direction. Only when force is exerted upon the spring of the bar 61, causing rotation of bar 61 about a pivotal connection with the hand grip assembly 31, does the bar 61 not contact with spur gear 60, thereby allowing rotation of rod 41 in either direction.

Figure 4:
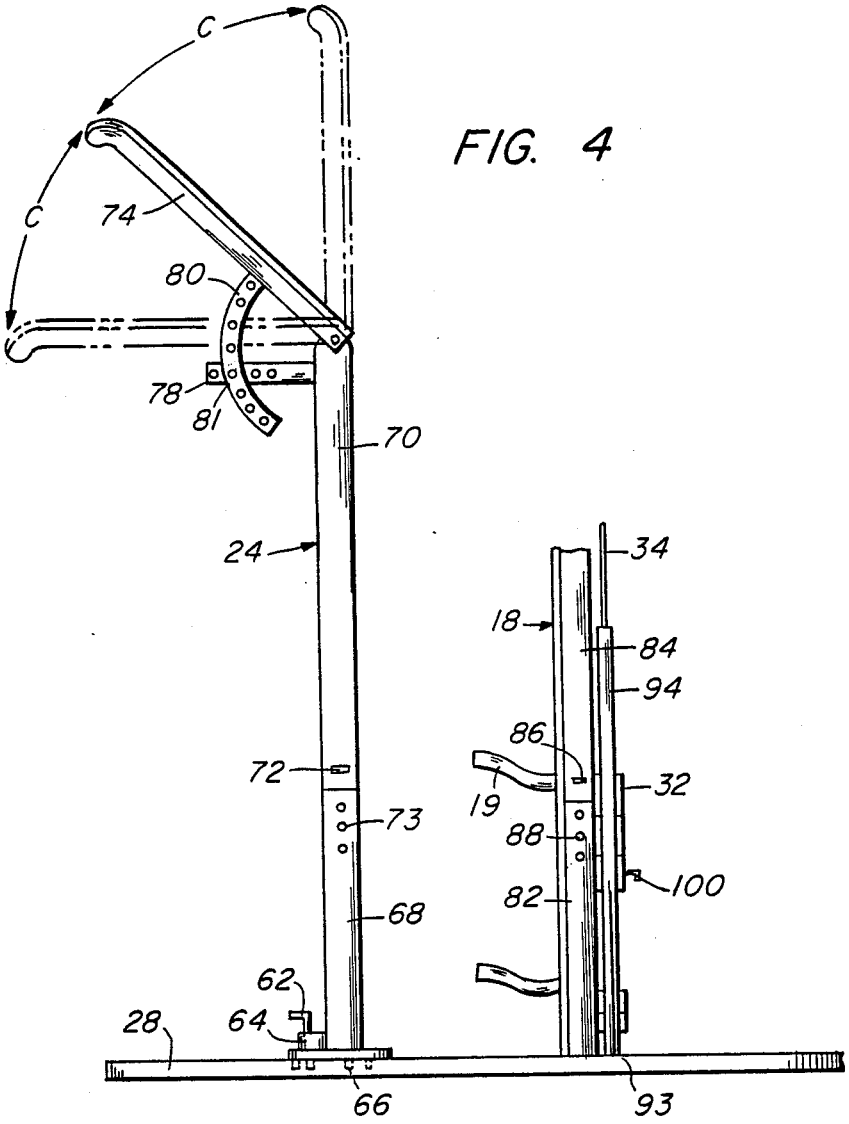
FIG. 4 is a partial side view of the body support portion of the present invention which supports the body of the user during exercise.

FIG. 4 illustrates a partial side view, in section, of the various body support structures of the exercise apparatus 10. Pictured therein is torso retainer 24 which extends from base plate 28. Retainer 24 is adjustably positioned along base plate 28 and attached thereto by screw pin 62 which extends through connecting plate 64 positioned at the bottom end of retainer 24. Screw pin 62 extends into any desired one of a plurality of holes 66 extending into base plate 28 to thereby attach retainer 24 to plate 28. The height of torso retainer 24 is also adjustable to allow users of differing heights to adjust the height of the retainer 24. In the preferred embodiment, the retainer 24 includes two pole members 68 and 70 which are slidably connected and secured theretogether by pin member 72. Pin 72 extends through one of a plurality of pinholes 73 extending through pole member 68. Pivotally attached at the top end of pole 70 of retainer 24 is support 74. Support 74 is held at a desired angle by means of a connection between track member 78 extending from pole member 70 and track member 80 extending from support 74, wherein track members 78 and 80 are connected together by a pin member 81.

FIG. 4 further illustrates a portion of support leg retainer 18 of the present invention. Similar to torso retainer 24, support leg retainer 18 includes two pole members 82 and 84 which are slidably connected and secured theretogether by pin member 86 extending through one of a plurality of pin holes 88 extending through pole member 82.

Figure 5:
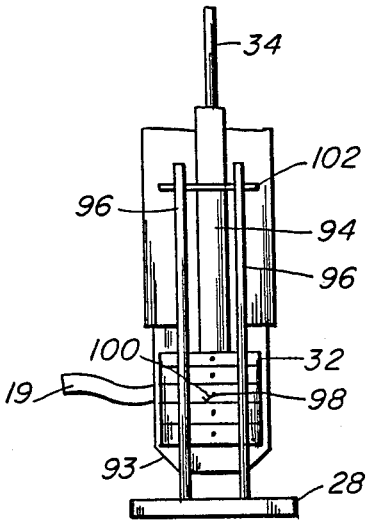
FIG. 5 is a partial side view illustrating the arrangement of mechanical dead weights which resist the flexing of the exercise leg of the user.

Illustrated in the side view of FIG. 4, and more fully in FIG. 5 are the mechanical deadweights 32 which function to resist movement of lower leg support 22. A plurality of mechanical deadweights 32 positioned upon base plate 28 above buffer spring 93 are slidably engaged with a riding post 94 and track members 96. Riding post 94 contains a plurality of holes extending therethrough along the length of the post. Each weight 32 contains a hole 98 extending transversely therethrough. A weight adjustment pin 100 extends through one hole 98 of a weight 32 and through a corresponding hole in riding post 94 to thereby attach that weight 32 to the post 94. Each weight 32 positioned above the weight attached to post 94 is thereby caused to be indirectly attached to post 94. Cable 34 is attached to the top end of post 94. Translation of cable 34 causes translation of riding post 94 and the weights 32 attached thereto. Upward translation of riding post 94 and the mechanical deadweights 32 is, however, limited by transversely positioned rod 102 connecting the top portions of the track members 96.

The operation of the present invention according to the embodiment of FIGS. 1–5, will now be described. In use, the exercise apparatus 10 of the present invention operates as an isotopic exercise device to develop those muscles used during a kicking motion, and in particular, an overhead kicking motion utilized in the sport of Karate. Teh apparatus 10 also stretches those same muscles. Referring again to FIG. 1, to reach the exercise position illustrated, the user 12 first positions his support leg 14 between the torso retainer 24 and support leg retainer 18. The vertical height of the torso retainer 24 and support leg retainer 18 is adjusted through suitable placement of pin members 72 and 86 through the desired pin holes 73 and 88, respectively. Torso retainer 24 is also positioned to allow screw pin 62 to extend into a desired hole 66. Strap members 19 are then positioned about the support leg 14 to support the support leg 14 of the user 12 against the support leg retainer 18. The exercise leg 16 of the user 12 is then positioned upon exercise leg support 20 and lower leg support 22. Preferably, supports 20 and 22 are pivoted about pivot 41 such that the exercise leg 16 of the user 12 is initially in an "unstretched" position. Extension 42 is adjusted so as to correspond to the size of user 12. Straps 23 may then be positioned around exercise leg 16 to support exercise leg 16 upon supports 20 and 22. In the preferred embodiment, the foot of the user 12 also extends through foot pad 50. Finally, torso retainer 26 is positioned at a desired angle to support the torso of the user 12 thereupon by suitable positioning of track members 78 and 80. Once positioned as much, the user 12 may thereafter perform a first exercise with the exercise apparatus 10.

In a first exercise, locking bar 48 is positioned to prevent support 22 from pivoting about pin 46, thereby causing both supports 20 and 22 to rotate about rod 41. As such, the apparatus 10 functions to stretch the leg muscles of exercise leg 16 of the user 12. By rotating crank grip 52 to causes rotating shaft 54, and hinge 39 to rotate, supports 20 and 22 are caused to rotate into the position illustrated in FIG. 1. Locking mechanism 59 causes the support to be locked into the position of the figure.

Once in the position of FIG. 1, a second exercise may be performed with the apparatus 10. By removing locking bar 48 to allow rotation of support 22 about pin 46, the knee of the user 12 may be flexed. Flexing ofo the knee joint of the exercise leg 16 of the user 12 causes translation of the riding post 94 and of the mechanical deadweights 32 attached thereto. Use of the apparatus 10 in this manner allows the leg muscles of the user 12 to be strengthened. By increasing the number of mechanical deadweights 32 attached to riding post 94, the force counteracting the movement of the flexing of the knee of the exercise leg 16 is increased. Through such an increase, a progressive development of the muscles utilized during a kicking motion may thereby be progressively developed.

Also, the user 12 may position himself such that, alternatively, the support leg 14 becomes the exercise leg 16 and vice versa. The exercise apparatus 10 may thereby be utilized to develop those muscles utilized during both an overhead kicking motion and an upwardly extending kicking motion for both the right and left leg of the user 12.

Figure 6:
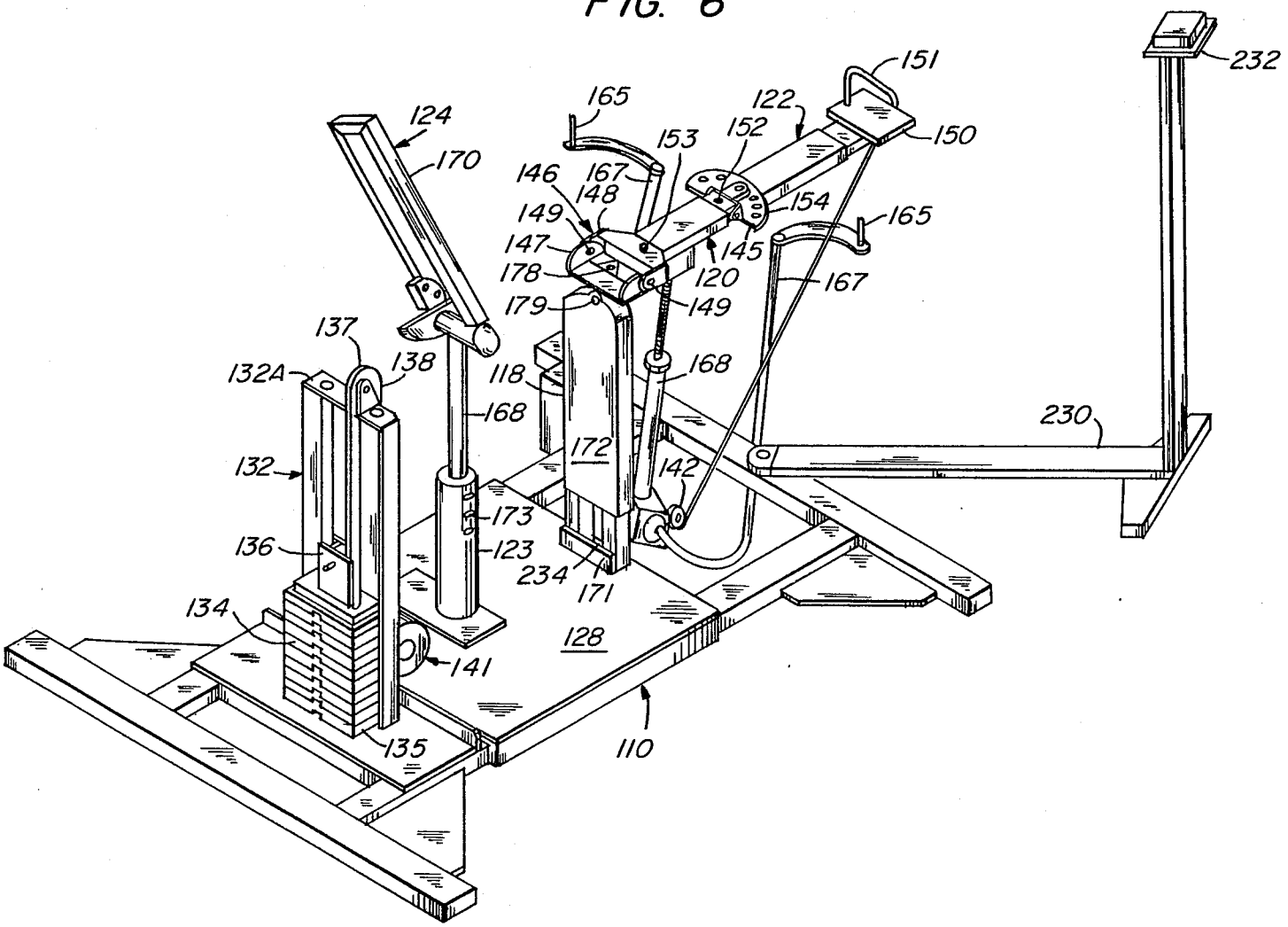
FIG. 6 illustrates a preferred embodiment of the present invention.
Figure 8:
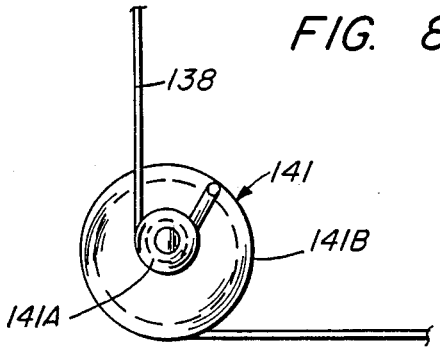
FIG. 8 is a partial side elevational view of two gang pulley arrangements used to reduce the travel distance by a weight stack during use of the apparatus shown in FIG. 6.

Referring now to the preferred embodiment illustrated in FIG. 6, the exercise apparatus shown therein is identified generally by reference numeral 110. Similar to the previously described embodiment, exercise apparatus 110 includes a vertically extending support 118, upper leg exercise support 120, and lower leg exercise support 122. Support 118 is mounted upon base plate 128 at a spaced apart relation from an upstanding pedestal 123 which supports a torso retainer 124. The pedestal 123 is situated on the bse plate between support 118 and an assembly 132 including exercise weights. Metal plates 134 are stacked one on top of the other upon a base plate 135. Guide bars 136 extend from plate 135 through suitable openings in the plates 134 and along opposite sides of a housing 136. The housing 136 is secured by a selector shaft which extends through aligned opening in the plate 134 and secured to plate 135 in a well known manner. The guide bars are secured to a cross head 132A of assembly 132. A pulley 137 is rotatably supported by the the cross head and trained about the pulley is a cable 138. One end of the cable is anchored to the cross head 132A. The cable extends from the anchor site downwardly and about pulley 139 thence upwardly to a point where the cable wraps about pulley 137, where the cable extends downwardly to a double sheave assembly 141. As shown in FIG. 8 the cable first wraps about the periphery of a relatively small diameter sheave member 141A. The cable then extends through an opening in the side of the sheave and thence through a side wall opening in a relatively large diameter sheave member 141B. The cable wraps about the periphery of the sheave member 141B and extends horizontally beneath base plate 128 to a guide pulley 142. From pulley 142 the cable angles upwardly to an attachment site at the underside of projected end portion of the lower leg exercise support 122. With a desired number of dead weights 134 stacked on base plate 135, pivotal movement of leg exercise support 122 causes vertical translation of the weights toward cross head 132A. Upper leg exercise support 120, can pivot horizontally about a vertical hinge pin 153 carried by horizontal pivot assembly 146. Lower leg exercise support 122 is made of two interfitting sections so that the length of support 122 can be changed. Lower exercise leg support 122 is made adjustable by the adjustable extension 122A thereof.

The leg supports 120 and 122 can pivot in unison about a horizontal pivot assembly 146 made up of two clevis members 147 and 148 which are joined together by pivot pins 149. The pivot pins 149 permit the generally vertical movement of both leg supports 120 and 122 by a gear drive, as more fully described hereinafter. The leg support 122 can swing horizontally in opposition to the force applied to the lower leg support 122 by cable 136. A foot pad 150 positioned at an end portion of the leg support 122 allows engagement with the users foot for positioning therewith. Angling above the foot pad 150 is a bent rod 151 for engagement at the users option to apply force to impart horizontal swinging motion of the lower leg support 122 relative to the upper leg support about hinge pin 152. Both leg supports 120 and 122 can pivot in a generally horizontal plane about pivot pin 153 in a vertical axis. This generally horizontal pivotal movement will also require lengthening or shortening of the cable extending between the base of the machine and the lower leg support 122. A semi-circular lock plate 154 is supported by the lower leg support 122 and provided with a plurality of openings which can be selected according to the relative angular relation between the upper and lower leg supports. A lock pin can be inserted to a lug extending from the upper leg support and providing with an opening that aligns with a selected one of the openings in the plate.

Figure 7:
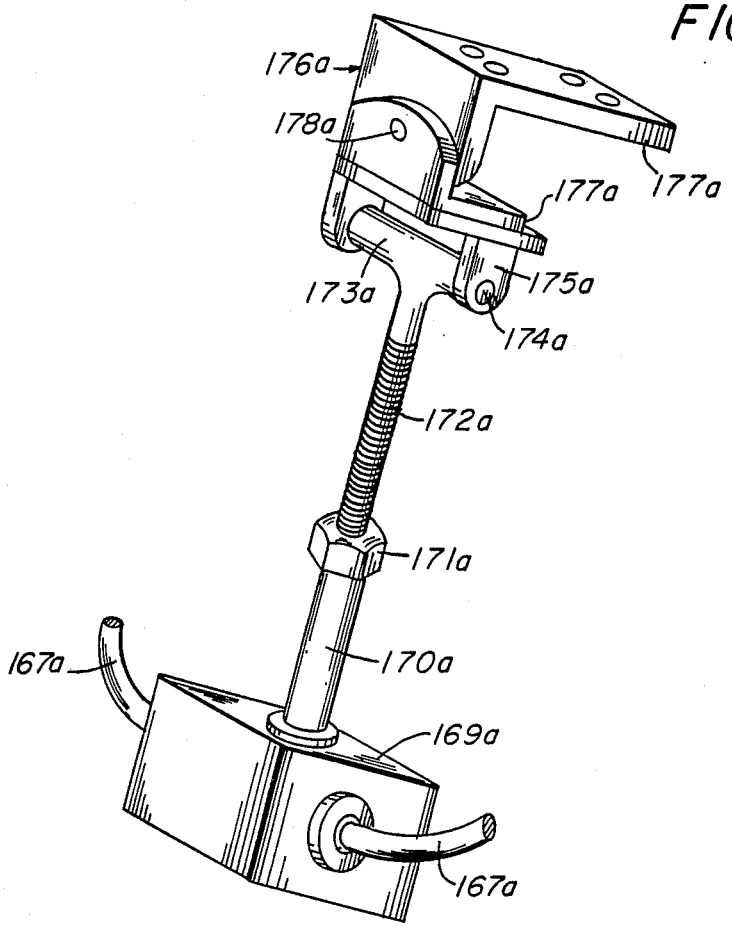
FIG. 7 is an isometric view of the gear box and an angling support utilized to alter the angle at which the exercise leg supports extends.

Vertical swinging movement of the upper and lower leg supports 120 and 122, respectively, is effected by a drive system which includes crank handles 165 secured to the ends of flexible cables which extend inside rigid support tubes 167 to opposite ends of a worm gear box 169. Referring to FIG. 7, the worm gear box, well known in the art, per se, is provided with flanges at opposite sides for anchoring the support tubes so that the handles 165 are positioned at desired locations at each of opposite sides of the leg exercise supports 120 and 122. Inside the gear box the flexible cables are separately engage with beveled gears situated at opposite sides of a pinion and mesh with the teeth thereof. The shaft of pinion gear is connected to a drive tube 170 that extends in a generally upward direction from a support site of the gear box near the base 128. A nut member 171 is secured to the end of the drive tube and threadedly engages the threads of a rod member 172. The rod member 171 can move into and out of the central space in the guide tube and the exposed upper end of the rod member is provided with a cross head 173 which is connected by a pivot pin 174 to a clevis 175. The clevis is in turn secured to a pivot assembly 176. The pivot assembly includes an L-shape plates 177 jointed together by a pivot pin 178. The pivot assembly 175 is attached to the underface surface of the upper leg exercise support 120. A pivot pin 178 allows a repositioning of the upper and lower leg supports so that exercising movement can be maintained in a vertical direction. In this regard, it will be noted that a pivot pin defines a pivot axis extending generally along the extended length of the upper and lower leg supports. These leg supports can be pivoted about another axis extending in a generally parallel relation to the pivot axis of pin 178. The second pivot axis is defined by a pivot pin 179 which is provided in the upper portion of the support leg retainer 118. Pivot pins 178 and 179 cooperate to allow the user to maintain vertical movement of the supports 120 and 122 by motorizing the pivot axis of pins 149 generally horizontally.

Torso support 180 is bipartite in construction to allow adjustment for user's of differing heights. Torso support 180 is comprised of support members 168 and 170. Support member 168 is mounted at a first end thereof by the pedestal 123, and can slide therein to select a desired elevation where they are secured theretogether by pin member 172. Pivotally attached at the top end of support member 168 of the is back support 170. Support 170 is held at a desired angle by means of a pinned connection between indexing member 178 extending from support 170, and indexing member 180 extending from support 168.

Support leg retainer 118 is bipartite in construction to provide vertical adjustability. Retainer 118 is comprised of support base 171 which is mounted upon base plate 128. Slidably connected with base 171 is support member 172. A pin, not shown 164 secures support members 171 and 172 theretogether when inserted into one of a plurality of pin holes extending through support member 182.

Exercise apparatus 110 of FIG. 6 allows a user to position the exercise leg support 120 at any desired angle relative to the support leg retainer. by rotating the handles 165 in a desired direction, the angle at which exercise leg support 120 extends from support leg retainer 118 may be altered.

Similar to the embodiment of the previous figures, lower exercise leg support 122 may be rotated about hinge pin 146 connecting support 120 and 122 theretogether. However, the embodiment of FIG. 6 allows a user to alternatively rotate lower exercise leg support 122 in the horizontal direction (in and out of the page of FIG. 6). By inserting pin the torso exercise leg support 120 and 122 are rigidly interconnected and allowed to swing as a unit in the horizontal direction.

Further illustrated in FIG. 6 is support structure 230 pivotally attached to base plate 128. Structure 230 supports digital readout 232. Digital readout 232 is electrically coupled to gear box 169 wherein gear box contains an analog signal indicative of the angle at which the leg supports 120 and 122 extend to a digital signal. Digital readout 232 allows display of this angle. Further illustrated in FIG. 6 is spring member 234. Spring member 234 is positioned to provide a spring force to biased support member 172 to reduce the force required to alter the vertical height of support leg retainer 118. Similarly, a spring member may also be positioned to provide a spring force to biased support member 70 relative to pedestal 123 of the torso support 124.

While the present invention has been described in connection with the preferred embodiment shown in the various figures, it is to be understood that other similar embodiments may be used or modifications and additions may be made to the described embodiment for performing the same functions of the present invention without deviating therefrom. Therefore, the present invention should not be limited to any single embodiment, but rather construed in breadth and scope in accordance with the recitation of the appended claims.

I claim as my invention:

1. Leg strengthening and stretching apparatus for aiding in the development of leg muscles of a user utilized in a kicking motion, including:

a body support for supporting the user in an upstanding position, said body support being comprised of a support leg retainer for retaining one leg of the user in an upright support position and a torso support for supporting the torso of the user in a desired position;

a first exercise leg support extending from said support leg retainer at a desired angle for supporting an upper leg of the user thereupon; and a second exercise leg support rotatably attached at an end portion of said first exercise leg support for supporting a lower leg portion of the user thereupon.

2. The leg strengthening and stretching apparatus of claim 1 further including resistance means attached to said second leg support to resist rotation of the second exercise leg support.

3. The leg strengthening and stretching apparatus of claim 2 wherein said resistance means includes mechanical dead weights engaged with the second exercise leg support to resist rotation thereof.

4. The leg strengthening and stretching apparatus of claim 3 wherein said mechanical dead weights are engaged with the second exercise leg support by a pulley and cable assembly.

5. The leg strengthening and stretching apparatus of claim 1 wherein said support leg retainer is of an adjustable height.

6. The leg strengthening and stretching apparatus of claim 1 wherein said torso support is of an adjustable height.

7. The leg strengthening and stretching apparatus of claim 1 wherein said first exercise leg support means includes an adjustment means to adjust the angle at which the first exercise leg support extends from the body support.

8. The leg strengthening and stretching apparatus of claim 7 further including means for determining the angle at which the first exercise leg support extends from the support leg retainer, and display means for displaying said angle.

9. The leg strengthening and stretching apparatus claim 1 wherein said first exercise leg support is of an adjustable length.

10. The leg strengthening and stretching apparatus of claim 1 further including a locking means attached to said second exercise leg support to prevent rotation of the second exercise leg support about the first exercise leg support.

11. The leg strengthening and stretching apparatus of claim 1 wherein said second exercise leg support is rotatably attached to the first exercise leg support by mated hinges extending from the respective leg supports, said mated hinges being coupled by a hinge pin.

12. The leg strengthening and stretching apparatus of claim 11 wherein mated hinges extending from the respective leg supports are positioned in both the vertical direction and the horizontal direction to allow alternative rotation of the second exercise leg support in either the vertical direction or the horizontal direction upon alternative coupling of the mated hinges positioned in either the vertical direction or the horizontal direction by the hinge pin.

13. Leg strengthening and stretching apparatus for aiding in the development of leg muscles of a user utilized in a kicking motion, including:

body supporting means including a support leg retainer retaining one leg of the user in an upright support position and a torso support for supporting the torso of the user in a desired position;

a first exercise leg support extending from said body support at an angle for supporting an upper leg of the user thereupon; and an adjustment means for adjusting the angle at which said first exercise leg support extends from said body support.

14. The leg strengthening and stretching apparatus of claim 13 further including a second exercise leg support rotatably attached at an end portion of said first exercise leg support for supporting a lower leg portion of the user thereupon.

15. The leg strengthening and stretching apparatus of claim 14 further including resistance means attached to said second exercise leg support to resist rotation of the second exercise leg support.

16. The leg strengthening and stretching apparatus of claim 15 wherein said resistance means includes mechanical dead weights engaged with the second exercise leg support to resist rotation of the support.

17. The leg strengthening and stretching apparatus of claim 16 wherein said mechanical dead weights are engaged with the second exercise leg support by a pulley and cable assembly.

18. The leg strengthening and stretching apparatus of claim 13 wherein said support leg retainer is of an adjustable height.

19. The leg strengthening and stretching apparatus of claim 13 wherein said torso support is of an adjustable height.

20. The leg strengthening and stretching apparatus of claim 13 wherein said first exercise leg support is of an adjustable length.

21. The leg strengthening and stretching apparatus of claim 14 wherein said second exercise leg support is rotatably attached to the first exercise leg support by mated hinges extending from the respective leg supports, said mated hinges being coupled by a hinge pin.

22. The leg strengthening and stretching apparatus of claim 21 wherein mated hinges extending from the respective leg supports are positioned in both the vertical direction and the horizontal direction to allow alternative rotation of the second exercise leg support in either the vertical direction or the horizontal direction upon alternative coupling of the mated hinges positioned in either the vertical direction or the horizontal direction by the hinge pin.

23. The leg strengthening and stretching apparatus of claim 13 further including means for determining the angle at which the first exercise leg support extends from the support leg retainer, and display means for displaying said angle.

* * * * *